US009241228B2

(12) United States Patent
Ng et al.

(10) Patent No.: US 9,241,228 B2
(45) Date of Patent: Jan. 19, 2016

(54) ADAPTIVE SELF-CALIBRATION OF SMALL MICROPHONE ARRAY BY SOUNDFIELD APPROXIMATION AND FREQUENCY DOMAIN MAGNITUDE EQUALIZATION

(75) Inventors: Samuel Samsudin Ng, Singapore (SG); Muralidhar Karthik, Singapore (SG); Sapna George, Singapore (SG)

(73) Assignee: STMICROELECTRONICS ASIA PACIFIC PTE. LTD., Singapore (SG)

( * ) Notice: Subject to any disclaimer, the term of this patent is extended or adjusted under 35 U.S.C. 154(b) by 1056 days.

(21) Appl. No.: 13/339,826

(22) Filed: Dec. 29, 2011

(65) Prior Publication Data

US 2013/0170666 A1 Jul. 4, 2013

(51) Int. Cl.
*H04R 3/00* (2006.01)
*H04R 25/00* (2006.01)
*H04R 29/00* (2006.01)

(52) U.S. Cl.
CPC ..... *H04R 29/006* (2013.01); *H04R 3/005* (2013.01)

(58) Field of Classification Search
CPC ..... H04R 3/005; H04R 25/407; H04R 1/406; H04R 1/20; H04R 25/405; H04R 29/006; H04S 2400/15
USPC ..... 381/92, 313, 122
See application file for complete search history.

(56) References Cited

U.S. PATENT DOCUMENTS

2006/0147054 A1 * 7/2006 Buck et al. ..... 381/92
2007/0055505 A1 * 3/2007 Doclo et al. ..... 704/226

OTHER PUBLICATIONS

Elko, A Simple Adaptive First-Order Differential Microphone, Air-Coupled Acoustic Microsensors Workshop, Aug. 24, 1999, pp. 1-11.
Buck et al., Self-Calibrating Microphone Arrays for Speech Signal Asquistion: A Systematic Approach, Signal Processing 86, 2006, pp. 1230-1238.

* cited by examiner

*Primary Examiner* — Vivian Chin
*Assistant Examiner* — Douglas Suthers
(74) *Attorney, Agent, or Firm* — Allen, Dyer, Doppelt, Milbrath & Gilchrist, P.A.

(57) ABSTRACT

Methods and apparatus for self-calibration of small-microphone arrays are described. In one embodiment, self-calibration is based upon a mathematical approximation for which a detected response by one microphone should approximately equal a combined response from plural microphones in the array. In a second embodiment, self-calibration is based upon matching gains in each of a plurality of Bark frequency bands, and applying the matched gains to frequency domain microphone signals such that the magnitude response of all the microphones in the array approximates an average magnitude response for the array. The methods and apparatus may be implemented in hearing aids or small audio devices and used to mitigate adverse aging and mechanical effects on acoustic performance of small-microphone arrays in these systems.

24 Claims, 6 Drawing Sheets

ADAPTIVE SELF-CALIBRATION OF SMALL MICROPHONE ARRAY BY SOUNDFIELD APPROXIMATION AND FREQUENCY DOMAIN MAGNITUDE EQUALIZATION

BACKGROUND

1. Technical Field

The present invention relates to directional microphone array systems and methods to calibrate directional microphone array systems.

2. Discussion of the Related Art

Directional microphone systems may be used in conjunction with high-fidelity audio systems to record and reproduce acoustic signals having directionality, such as signals originating from different locations. Examples of signals having directionality include an aircraft flying overhead, different instrumental sections at different locations in a large orchestra, sounds originating from different players on a sport field and sounds from spectators. The recording and reproduction of acoustic signals having directionality can improve the realism of the reproduced sound field for the benefit of the listener.

A directional microphone system used to detect acoustic signals having directionality can comprise a microphone array and associated electronics for digital processing of the detected signals. Some of these systems delay and subtract the multiple microphone signals in a method known as differential microphone technique. (See, G. W. Elko, "*A Simple Adaptive First-order Differential Microphone*", Air-Coupled Acoustic Microsensors Workshop (1999)) In some applications, digital processing and differential microphone techniques are used to acquire B-format signals, which consist of three coincident signals: an omnidirectional signal and two dipole (figure-of-eight) signals with polar directivity pattern that point to the front-back and left-right directions. These signals can be acquired from a low-cost, closely spaced omnidirectional microphone array comprising at least three microphones arranged in a two-dimensional configuration. The B-format omnidirectional signal can be acquired from any one microphone in the array. The two dipole signals can be acquired by differential microphone techniques using plural microphones in the array.

To produce B-format polar directivity patterns, e.g., for the dipole signals, responses of the microphones in the array should be closely matched in terms of amplitude response and phase response. One method for matching responses of the microphones is to measure and sort the microphones manually during manufacturing so as to select sets of microphones wherein each microphone in a set has a response closely matched to responses of other microphones in the set. Another method is to run a calibration routine during assembly, and digitally compensate the mismatches via digital filtering embedded in the platform where the microphone array is to be used.

The terms used herein referring to matching the responses or equalizing the responses of microphones are used in reference to an ideal condition in which plural microphones receiving an identical acoustic disturbance produce substantially identical responses, e.g., substantially identical electrical signals at all response frequencies.

Equalization of the microphone responses in an array with adaptive filtering is also possible, for example, by using one of the microphones in the array as a desired or reference signal, and adapting all the other microphone's signals according to the reference signal. (See, M. Buck, T. Haulick, H. Pfleiderer, "Self-calibrating microphone arrays for speech signal acquisition: A systematic approach", Signal Processing 86, pp. 1230-1238, Elsevier (2006)) An example of an adaptive filtering unit 100 is shown in FIG. 1, which includes delay element 110. A detected signal $x_{IC,\mu}(k)$ (for example, from one of the microphones in the array) is matched to the reference signal $d_{IC,\mu}(k)$ by an adaptive filter 120.

Output signals from the unit of FIG. 1 may include a calibrated signal $x^C_{IC,\mu}(k)$ and an error signal $e_{IC,\mu}(k)$. The error signal can be used to update adaptive filter coefficients in filter 120 such that the difference between the reference signal, or a delayed version of the reference signal, and the calibrated signal is minimized. In this manner, the calibrated signal $x^C_{IC,\mu}(k)$ can be approximately matched to the reference signal $d_{IC,\mu}(k)$.

FIG. 2 shows a possible embodiment of microphone self-calibration for multiple microphones in a microphone array. The filter blocks 210 correspond to the filtering unit depicted in FIG. 1. In the embodiment of FIG. 2, each microphone in the array may be matched to a reference microphone, which may be an independent reference microphone not in the array or any one of the microphones in the array. Many conventional adaptive microphone calibration methods work in this manner, i.e., using adaptive filtering to match the response of each microphone in an array to a selected reference response. The correction of microphone responses may be carried out once during assembly of a device incorporating the microphone array.

Manual sorting and grouping of microphones with similar responses can be time-consuming and labor-intensive. Further, due to component aging and other mechanical factors, matched responses of microphones in a set is not guaranteed over the long term. Similarly, running calibration and digital compensation procedures during assembly of a microphone array platform can also be time-consuming and require expensive measurement and calibration equipment. Additionally, due to aging and/or packaging of the array, microphone responses may change over time and the initial calibrations become obsolete. Re-calibrations would then be required.

The inventors have contemplated that adaptive calibration techniques can be useful in directional microphone array systems when implemented as self-calibration methods that can be executed by the system repeatedly over the lifespan of the system. The inventors have recognized that previous techniques for calibrating microphones may not be suitable for use over the lifetime of a device due to the expensive calibration equipment needed and/or time or cost required to run a calibration procedure. The inventors have also recognized that adaptive filter compensation systems like those depicted in FIG. 2 may not accurately match microphone responses, since these systems typically compensate for magnitude of the acoustic signals, but not the phase. For example, when the microphones in the array are spaced apart at various distances, the phase of the signals in each microphone may be different depend on the incoming sound direction. In an uncontrolled environment, the adaptive filter may equalize the magnitude properly, but not the phase.

SUMMARY

The present invention is directed to self-calibration of microphones in directional microphone array systems. The inventors have developed methods and systems for adaptively calibrating microphones in a directional microphone array system using low-complexity algorithms that may be used in an on-board processor coupled to the microphone array. For example, the calibration routines can be carried out with an on-board microcontroller, microprocessor, ASIC, or digital signal processor. The methods and systems can be used to adaptively adjust microphone responses to compensate for long term variations in the microphone responses due to component aging and other physical factors. The calibration routines can be executed by the system repeatedly over the lifespan of the microphone array system and not require extensive processing power. In some embodiments, an adaptive self-calibration process compensates for amplitude and phase variations.

According to one embodiment, a method for adaptive self-calibration comprises matching an approximation of an acoustic response calculated from a plurality of responses from microphones in the array to an actual acoustic response measured by a reference microphone in the array. The inventors have found that the method provides satisfactory results for arrays with small dimensions, and that the self-calibration techniques is substantially independent of the incoming sound direction. Further, the method accounts for phase factors associated with each microphone. The reference microphone may be selected to be any one of the microphones in the array. The self-calibration may implement adaptive filtering wherein the reference microphone provides a reference signal, and the approximation of the acoustic response serves as a detected signal for which compensation will be made.

According to a second embodiment, a method for self-calibrating directional microphone arrays comprises a low-complexity frequency-domain calibration procedure. According to this method, magnitude response matching is carried out for each microphone with respect to an average magnitude response of all the microphones in the array. The method further comprises calculating matching gains in each of a plurality of Bark frequency bands, and applying the matched gains to the frequency domain microphone signals such that the magnitude response of all the microphones in the array approximates the average magnitude response.

The foregoing and other aspects, embodiments, and features of the present teachings can be more fully understood from the following description in conjunction with the accompanying drawings.

BRIEF DESCRIPTION OF THE DRAWINGS

The skilled artisan will understand that the figures, described herein, are for illustration purposes only. It is to be understood that in some instances various aspects of the invention may be shown exaggerated or enlarged to facilitate an understanding of the invention. In the drawings, like reference characters generally refer to like features, functionally similar and/or structurally similar elements throughout the various figures. The drawings are not necessarily to scale, emphasis instead being placed upon illustrating the principles of the teachings. The drawings are not intended to limit the scope of the present teachings in any way.

The features and advantages of the present invention will become more apparent from the detailed description set forth below when taken in conjunction with the drawings.

DETAILED DESCRIPTION

By way of introduction, embodiments of the invention described below are applicable in the field of directional sound acquisition wherein small microphone arrays are used for signal acquisition. Small microphone arrays maybe used for directional signal acquisition and amplification in hearing aids, or they may be used as a directional microphone system to acquire first order B-format signals, which encode a soundfield having directional sounds into a data recording for subsequent surround sound playback. Such microphone systems may also be used for B-format or surround sound recording with small hand-held portable electronic devices, for example, mobile phones, PDAs, camcorders, audio devices, portable computers, computing tablets and pads, etc. For example, a small microphone array may be incorporated into any of these devices and provide easily portable surround-sound recording capability at minimal cost.

When small microphone arrays are used to record soundfields including directional sounds, the degree to which responses of microphones in the array are matched can significantly influence the quality of the recorded directional sound and therefore the quality or realism of the reproduced soundfield upon playback. For example, sound recorded with a directional microphone array having poorly matched responses would yield, upon playback, an audio soundfield for which it would be difficult to discern any directionality to the reproduced sounds. Sound recorded with a directional microphone array having well-matched responses would yield, upon playback, a realistic soundfield in which different sounds from different sources would seem to originate from different physical locations with respect to a listener's location. Accordingly, for quality recording and reproduction of directional soundfields using small directional microphone arrays, it is important to have well-matched microphone responses and that the microphone responses remain well-matched over the useful lifespan of the array.

Figure 1:
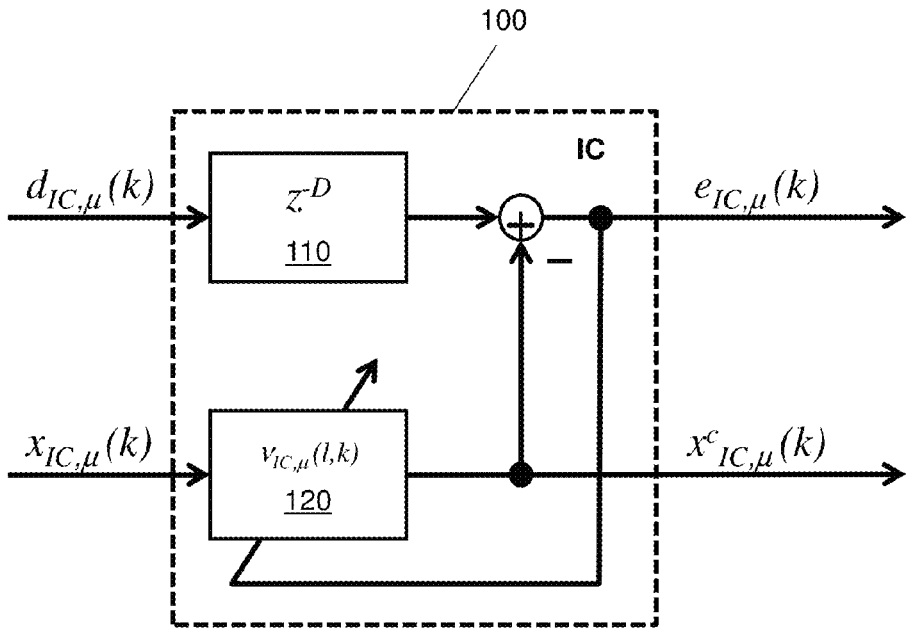
FIG. 1 is a block-diagram representation of an adaptive filtering unit configured to compensate an acoustic response for a detected signal $x_{IC,\mu}(k)$ to match or approximately match a reference signal $d_{IC,\mu}(k)$.
Figure 2:
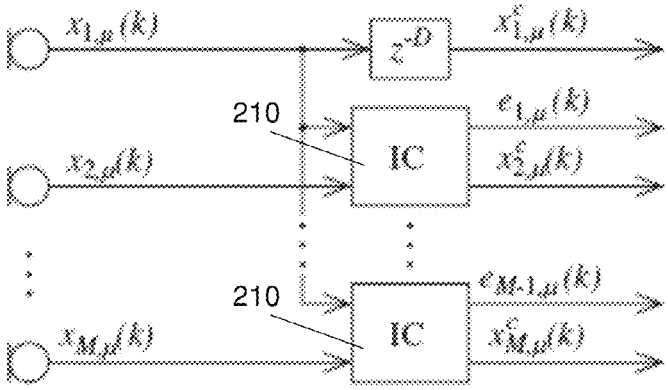
FIG. 2 is a block-diagram representation of an adaptive calibration system for a plurality of signals.
Figure 3:
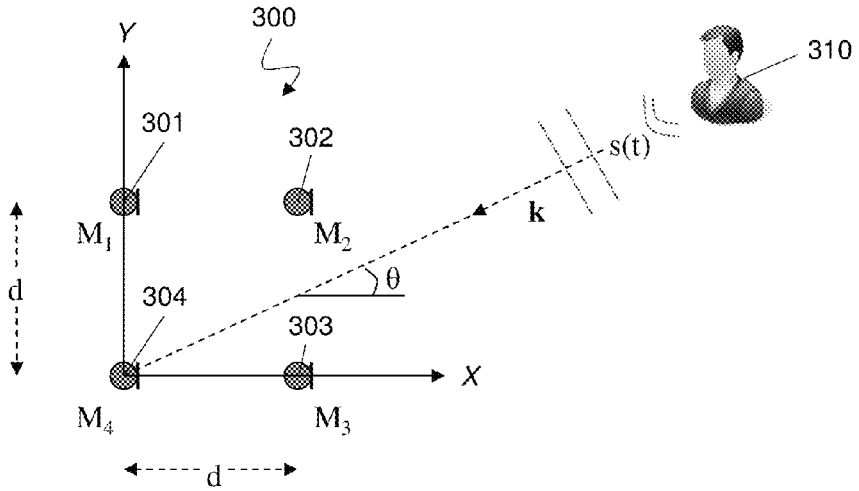
FIG. 3 depicts a directional microphone array according to one embodiment.

FIG. 3 and FIG. 4 depict apparatus and techniques for matching responses of microphones in small directional microphone arrays according to one embodiment of the invention. Shown in the figures are four microphones $M_1$ 301, $M_2$ 302, $M_3$ 303, and $M_4$ 304 disposed in a two-dimensional pattern forming a directional microphone array 300 configured to record directional sound. Output from the microphones may be provided to a signal processing system 400 configured to calibrate at least some of the microphone responses according to the methods described below. For the illustrated embodiment of FIGS. 3-4, the microphones are disposed in a square grid with a spacing d between the microphones.

Though FIGS. 3-4 depict four microphones in a two-dimensional configuration for purposes of explanation, in other embodiments of the invention there may be more or fewer microphones than four. In some implementations, the microphones may be disposed in a three-dimensional configuration or a one-dimensional configuration.

As shown in FIG. 3, one of the microphones 304 may be identified as a reference microphone, and considered to be located at an origin of a Cartesian coordinate system that is used as a frame of reference. A source of sound 310 is located a distance from the microphone array 300 at an angle θ with respect to an X axis of the coordinate system. By way of explanation, an incoming plane-wave acoustic signal s(t) with wave-vector k originating from source 310 is considered to produce an acoustic disturbance at the location of microphone $M_4$ 304. The spectral signal detected by microphone $M_4$ is defined as $M_4(\omega)$, and it is assumed that the spectrum of the signal acquired by $M_4$ is $S(\omega)$.

$$M_4(\omega)=S(\omega) \tag{1}$$

The signal delay with respect to the location of the reference microphone $M_4$ 304 can be calculated at other microphones in the array, e.g., $M_1$, $M_2$ from geometrical considerations. The calculation of delay can account for phase differences in signals received by the microphones. For a case where all microphones in the array 300 are well matched, it is assumed that the frequency response of all the microphones in the array are matched (substantially identical). For such a case and accounting for the phase differences, the spectrums of the signals acquired by the other three microphones can be calculated theoretically as follows:

$$\begin{aligned} M_1(\omega) &= S(\omega)\cdot e^{\frac{j\omega d\sin\theta}{c}} \\ M_2(\omega) &= S(\omega)\cdot e^{\frac{j\omega d(\cos\theta+\sin\theta)}{c}} \\ M_3(\omega) &= S(\omega)\cdot e^{\frac{j\omega d\cos\theta}{c}} \end{aligned} \tag{2}$$

where θ is an angle with respect to the X axis indicating the direction of the sound source, d the microphone spacing, and c the speed of sound.

Approximations can be made when the terms in the exponents are very small, i.e., $e^{\alpha}=(1+\alpha)$ for small α. Using this approximation, EQ. 2 can be rewritten as:

$$\begin{aligned} M_1(\omega) &\approx S(\omega)\cdot\left(1+\frac{j\omega d\sin\theta}{c}\right) \\ M_2(\omega) &\approx S(\omega)\cdot\left(1+\frac{j\omega d(\cos\theta+\sin\theta)}{c}\right) \\ M_3(\omega) &\approx S(\omega)\cdot\left(1+\frac{j\omega d\cos\theta}{c}\right) \end{aligned} \tag{3}$$

For the approximations in EQ. 3 to be reasonably accurate, $\omega d \ll c$. This condition amounts to $d \ll \lambda$, or the microphone spacing d must be much less than the wavelength 2 of a detected signal. For microphone spacings of 1 centimeter (cm) or less, the approximations are valid for most human-audible frequencies.

From EQ. 1 and EQ. 3 it can be seen that $$M_4(\omega)\approx M_1(\omega)+M_3(\omega)-M_2(\omega) \tag{4}$$

According to EQ. 4, the responses from plural microphones in the small microphone array can be theoretically combined using reasonable mathematical approximations to yield an approximate equality between a response from a reference microphone ($M_4$) and a combined response from plural microphones ($M_1$, $M_2$, $M_3$) in the array. The combined response may be referred to as an approximation response or approximation signal. Expressed alternatively, the combination of responses from plural microphones in the array mathematically approximates a response from a reference microphone. However, this approximate equality is only valid according to the assumptions made above in deriving EQ. 4: the responses of the microphones are well matched, each exhibiting a spectral response substantially equal to S(ω). Thus, when responses from the plural microphones ($M_1$, $M_2$, $M_3$) are filtered or adjusted such that EQ. 4 is substantially balanced, then the microphone outputs have been compensated to exhibit well-matched responses.

In some embodiments, EQ. 4 can be used as a guide for adaptive self-calibration of the microphones in the array. For example, a self-calibration system may be realized by configuring a signal processing system 400 to detect signals from each of the microphones and equalize the signals according to EQ. 4. Since the algorithm accounts for phase factors, the self-calibration system matches the microphone responses more accurately than conventional systems based on magnitude only. In some embodiments, the calibration may be performed in any condition as it is independent of the incoming sound source direction, e.g., EQ. 4 shows no directional dependence since the phase terms have cancelled.

Figure 4A:
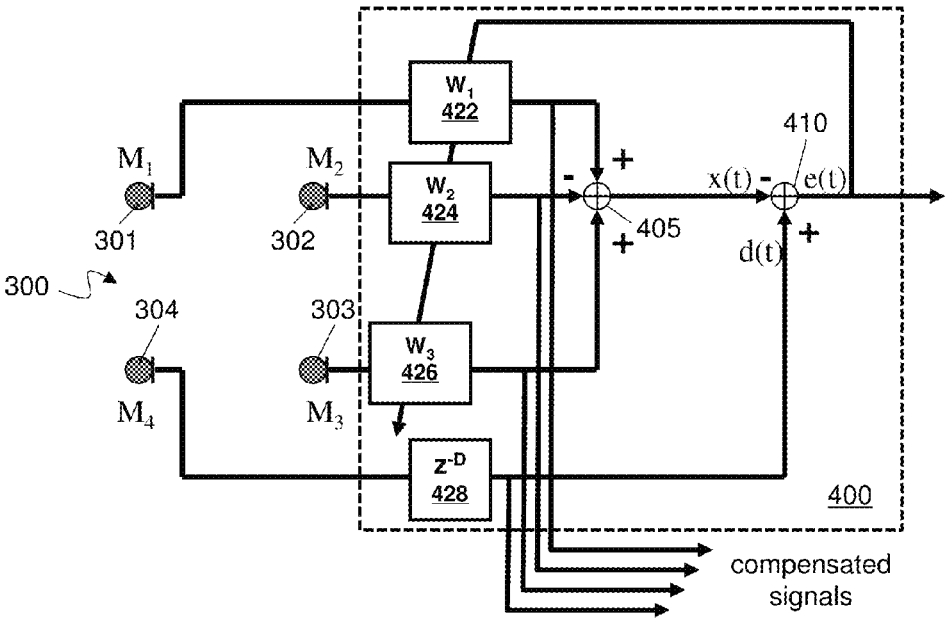
FIG. 4A depicts a directional microphone array system configured for adaptive self-calibration according to one embodiment.

FIG. 4A depicts one embodiment of a system for adaptive self-calibration of a small directional microphone array, for example, a directional microphone array as depicted in FIG. 3. The system may include a small directional microphone array 300 configured to provide signals representative of detected acoustic disturbances to a signal processor 400. The signals may be provided to the signal processor 400 over a wired or wireless link. The maximal spacing between any two microphones in the array may be between about 1 cm and about 5 mm in some embodiments, between about 5 mm and about 2 mm in some embodiments, between about 2 mm and about 1 mm in some embodiments, between about 1 mm and about 0.5 mm in some embodiments, and yet between about 0.5 mm and about 0.2 mm in some embodiments. Signal processor 400 may comprise filter units 422, 424, 426 for each microphone, delay element 428, a combiner 405, and a comparison unit 410. Any of the filter units, delay element, combiner, and comparison unit may be implemented in hardware only, e.g., digital and/or analog circuitry, or may be implemented in a combination of hardware and machine-readable instructions executed by at least one processor. Some or all of the elements may be implemented in machine-readable instructions executed by at least one processor. The machine-readable instructions may be stored on a memory device that can be accessed by the at least one processor.

For the embodiment shown in FIG. 4A, adaptive filtering may be carried out using a measured signal from microphone $M_4$ 304 as the reference signal d(t). Signals from plural other microphones ($M_1$ 301, $M_2$ 302, $M_3$ 303) in the array are combined to form a combined signal x(t) according to EQ. 4 that is compared with the reference signal at comparison unit 410. The signal from the reference microphone may be delayed prior to the comparison. The comparison produces error signal e(t) that may be used to update coefficients of the calibration filters $W_1$-$W_3$ so as to substantially match the responses of the four microphones. Any suitable algorithm may be used for the adaptive filtering, such as a least mean square (LMS) algorithm, a minimum mean squared error (MSE), least squares error (LSE), or similar algorithms for reducing error of compared signals.

The responses of the microphones may be considered to be substantially matched according to one or more constraints.

For example, the responses may be considered to be substantially matched when the combined signal x(t) equals the reference signal d(t) to within ±20% in some embodiments, ±10% in some embodiments, ±5% in some embodiments, and yet ±2% in some embodiments. In some implementations, the responses may be considered to be substantially matched when a response measured from any microphone in the array equals a reference response or an average response to within ±20% in some embodiments, ±10% in some embodiments, ±5% in some embodiments, and yet ±2% in some embodiments.

Though FIG. 4A depicts four microphones located in a plane, it will be appreciated that other small microphone configurations having more or fewer microphones configured in two dimensions or three dimensions are contemplated as being within the scope of the invention. For example and in reference to FIG. 4A, another microphone configuration may be three dimensional for which microphone $M_2$ is located a distance d above microphone $M_4$ and out of the plane of microphones $M_1$, $M_3$, $M_4$. In such a configuration, the microphones may define a three-dimensional frame of reference with orthogonal axes. For each microphone configuration, an equation may be derived following similar methodology used to derive EQ. 4 to find an approximate mathematical relationship between plural microphones in the array and a reference microphone. The derived approximate relationship may be used as a guide to match the responses of the microphones.

FIG. 4A depicts signals combined and compared in the time domain, e.g., x(t), d(t), e(t). In some embodiments, signals may be combined and compared in the time domain while in other embodiments signals may be combined and compared in the frequency domain. Time-to-frequency and/or frequency-to-time conversions may be carried out as part of the signal processing using Fourier and inverse Fourier transforms. For example, filtering units 422, 424, 426 may each convert error signal e(t) to the frequency domain for analysis and application of filter coefficients in the frequency domain.

Figure 4B:
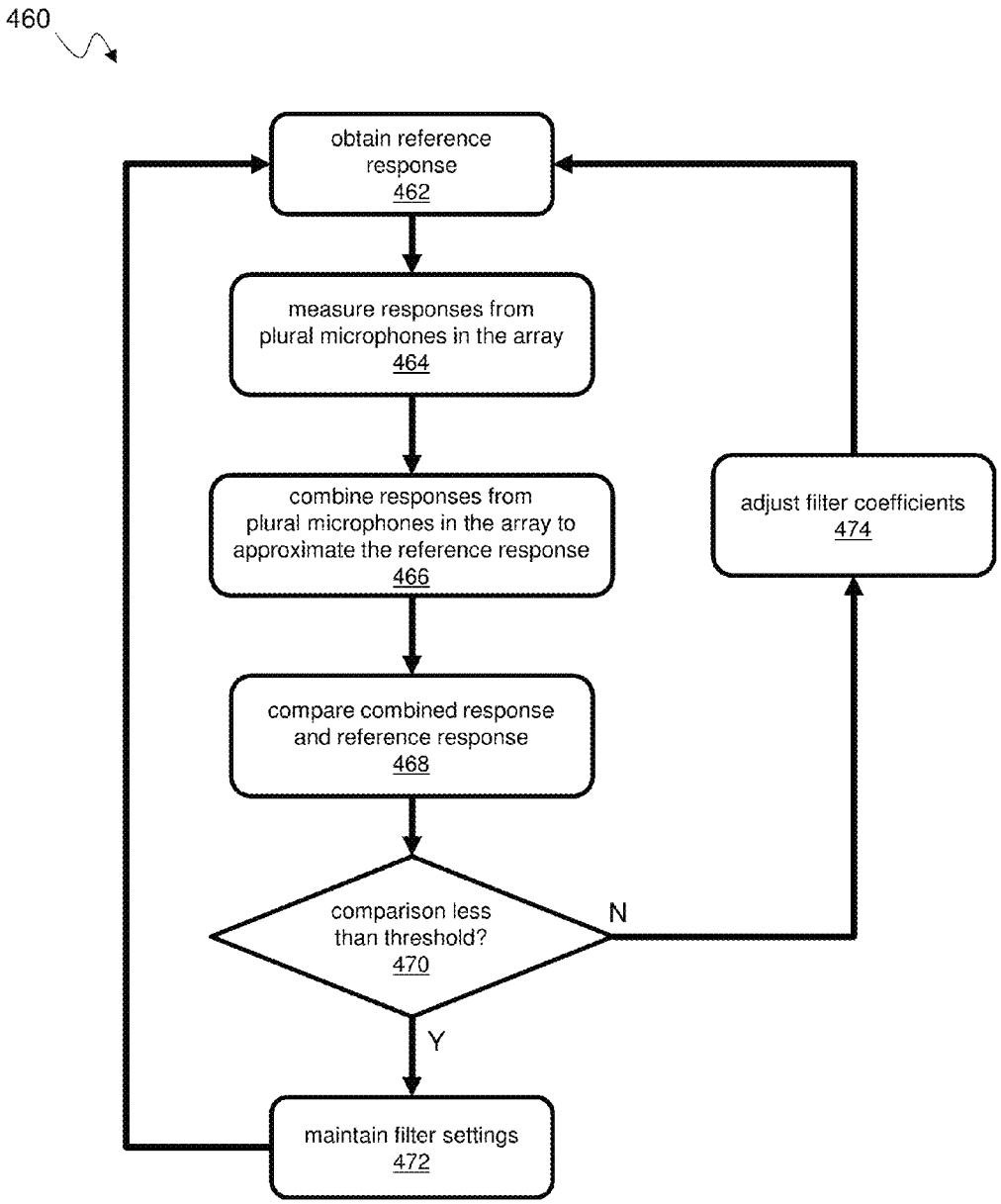
FIG. 4B is a flow chart illustrating a method for self-calibration of small microphone arrays according to one embodiment.

A method 460, depicted in FIG. 4B, for adaptive self-calibration of small microphone arrays may be implemented for a self-calibration system as depicted in FIG. 4A. According to one embodiment of an adaptive self-calibration method, the method may comprise acts of obtaining 462 an acoustic reference response, e.g., measuring a response from a reference microphone $M_4$ 304 or reading a reference response from a data file, and measuring 464 acoustic responses from a plurality of microphones in the array, e.g., $M_1$ 301, $M_2$ 302, and $M_3$ 303. The responses may be received by signal processor 400 as data signals that can be processed using digital and/or analog signal processing methods.

The method 460 may comprise combining 466 the responses from the plurality of microphones to form a combined response that approximates a reference response. For example, the responses from microphones $M_1$, $M_2$, and $M_3$ may be combined according to EQ. 4 to form a combined response. The combining of responses from the plurality of microphones may be done in a manner that approximates a phase relationship for at least one of the plurality of microphones. The combining of responses from the plurality of microphones may further be done in a manner that approximates a response from the reference microphone $M_4$.

The combined response may be compared 468 with the reference response. For example, a difference or error signal may be derived from the comparison, and the difference may be compared 470 against a predetermined threshold value. If the difference is greater than the predetermined threshold value, then control for the method may branch to an act of adjusting 474 filter coefficients or parameters for one or more of the plurality of microphones in the array. The filter coefficients or parameters may be adjusted such that the combined response more closely approximates the reference response. In some embodiments, the filter coefficients or parameters may be adjusted such that the error signal is minimized. The amount of adjustment of filter coefficients may be determined based on the size and/or characteristics of the difference or error signal. If the difference is less than the predetermined threshold value, then current filter settings may be maintained 472.

The method 460 may repeat automatically returning to the act of obtaining 462 an acoustic reference response. The repeating of the method 460 may occur on power-up of a device incorporating the microphone array, or at predetermined time intervals, such as once per hour, once per day, once per month.

According to another aspect of the invention, low-complexity, frequency-domain self-calibration apparatus and methods may be used to match microphone responses, as depicted in FIG. 5. In overview and according to one embodiment, the spectral responses from the microphones may be divided into a plurality of fast Fourier transform (FFT) frequency bins. The power spectral density (PSD) values for each microphone signal may be calculated for each FFT bin, and then mapped to Bark-frequency bands. The Bark-band PSD values for all microphones may be averaged to produce an average spectral response. The averaged spectral response may be used to provide reference PSD values. Spectral equalization gain values may be obtained for each microphone by taking the ratio of a measured PSD value and a reference PSD value at each Bark band. To avoid abrupt changes in filtering, the calculated equalization gain values for a current processing block may be smoothed over time with respect to the previous processing blocks, e.g., by using a running average algorithm over time. The equalization gain values may be applied to the respective frequency-domain microphone signals via filters to yield compensated output signals with magnitude responses substantially matched. Although the low-complexity method according to this embodiment compensates magnitude responses, it does not compensate for mismatches in phase response between the microphones.

Figure 5A:
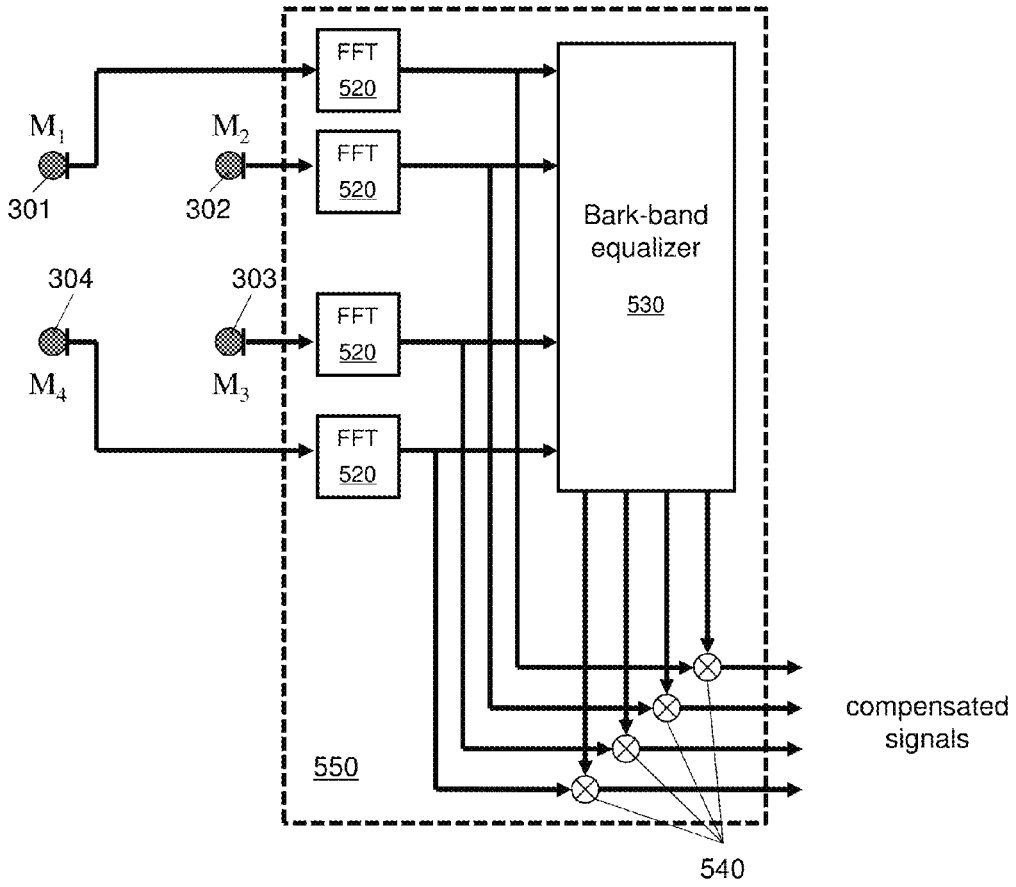
FIG. 5A depicts a directional microphone array system configured for adaptive self-calibration according to one embodiment.

FIG. 5A shows an embodiment of a low-complexity, frequency-domain self-calibration system for a small microphone array configuration such as that depicted in FIG. 3. The system may comprise a plurality of microphones, for example four microphones $M_1$ 301, $M_2$ 302, $M_3$ 303, $M_4$ 304, that may be coupled to signal processing apparatus 550. The coupling between the microphones and the signal processing apparatus may be wired or wireless, e.g., an RF link. The signal processing apparatus 550 may include at least one FFT unit 520, a Bark-band equalizer 530, and multipliers 540. The at least one FFT unit 520 may be coupled to an input of the Bark-band equalizer 530, and an output of the Bark-band equalizer may be coupled to a multiplier 540. Though four microphones are depicted in FIG. 5A, the self-calibration system may comprise microphone arrays with fewer or more microphones.

The FFT units, Bark-band equalizer, and multipliers may be implemented in hardware only, e.g., digital and/or analog circuitry, or may be implemented in a combination of hardware and machine-readable instructions executed by at least one processor. In some embodiments, any or all of the FFT units, Bark-band equalizer, or multipliers may be implemented as machine-readable instructions executed by at least one processor. The machine readable instructions may be stored in a memory device that can be accessed by the at least one processor. As one non-limiting example, the FFT units 520 may be implemented as analog-to-digital converters in combination with a microprocessor executing FFT or DFT algorithms. In some embodiments, the functionalities of the Bark-band equalizer 530 and multipliers 540 may be implemented with a microprocessor. In some implementations, the FFT units 520 may be incorporated as part of a microphone array platform, e.g., packaged with the microphones 301-304.

Though separate FFT units 520 are shown for each microphone, in some embodiments a single FFT unit may be used to transform signals from all microphones in the array, or a number of FFT units less than the number of microphones may be used to transform signals from the microphones. For example, signals from two or more microphones may be time multiplexed and provided to a single FFT unit in different time slots, so that the FFT may transform the signals from the two or more microphones during different time intervals.

In operation, the FFT units 520 may be configured to transform the microphone signals into the frequency domain for subsequent frequency-domain processing. For example, an FFT unit may receive a signal that varies as a function of time, and transform the signal using an FFT or DFT algorithm into spectral data representing a frequency composition of the signal. The data representing the frequency composition of the signal may be divided or parsed into a plurality of frequency bins, each bin spanning a range of frequencies. Subsequent frequency-domain processing may operate on the spectral data.

The multipliers 540 may be configured to receive a first signal and a second signal, different from the first signal, and provide an output that is a multiplication of the first signal and second signal. The multipliers may be implemented in hardware, e.g., analog or digital devices, or implemented as machine-readable instructions executing on at least one processor.

In operation and according to one method, the Bark-band equalizer 530 may be configured to calculate power spectral density values for a plurality of Bark bands for each of a plurality of microphones from signals received by the equalizer 530. The signals received by the Bark-band equalizer 530 may be spectral signals from FFT units 520, for example. The calculation of PSD values for each Bark band, designated by index b, may be carried out according to the following expression $$PSD_{M_j}(i, b) = \sum_{k=k_b}^{k_{b+1}-1} \sqrt{|M_j(i, k)|^2} \tag{5}$$

in which i refers to the frame (time) index, k refers to the FFT bin index, $k_b$ refers to the FFT-bin border index corresponding to Bark band index b, j represents a microphone index, and $M_j(i,k)$ refers to the frequency domain signal captured by microphone j.

An average PSD at any Bark band b may be calculated according to $$PSD_{Avg}(i, b) = \frac{1}{N} \cdot \sum_{j=1}^{N} PSD_{M_j}(i, b) \tag{6}$$

where N represents the number of microphones in the array. Subsequently, a Bark-band equalization gain for each Bark band associated with microphone j may be calculated according to $$eqGain_{M_j}(i, b) = \frac{PSD_{Avg}(i, b)}{PSD_{M_j}(i, b)}. \tag{7}$$

To prevent unwanted artifacts, the Bark-band equalization gain values $eqGain_{M_j}(i,b)$ may be limited as well as smoothed over time in some embodiments. The Bark-band equalization gain values may be subsequently mapped to a corresponding FFT-bins according to $$egGainFFT_{M_j}(i,k)=eqGain_{M_j}(i,b_k) \tag{8}$$

where $b_k$ represents the bark-bin index b which corresponds to FFT-bin index k. The value of gain might change abruptly between adjacent FFT bins and may cause undesired artifacts. The gain may be smoothed over the frequency bins to minimize such artifacts.

Finally, the equalization gain values for the FFT bins may be applied to the frequency-domain microphone signals according to $$M_{j,Eq}(i,k)=M_j(i,k)\times eqGainFFT_{M_j}(i,k) \tag{9}$$

where $M_{j,Eq}$ (i,k) represents a compensated or equalized frequency-domain microphone signal.

Figure 5B:
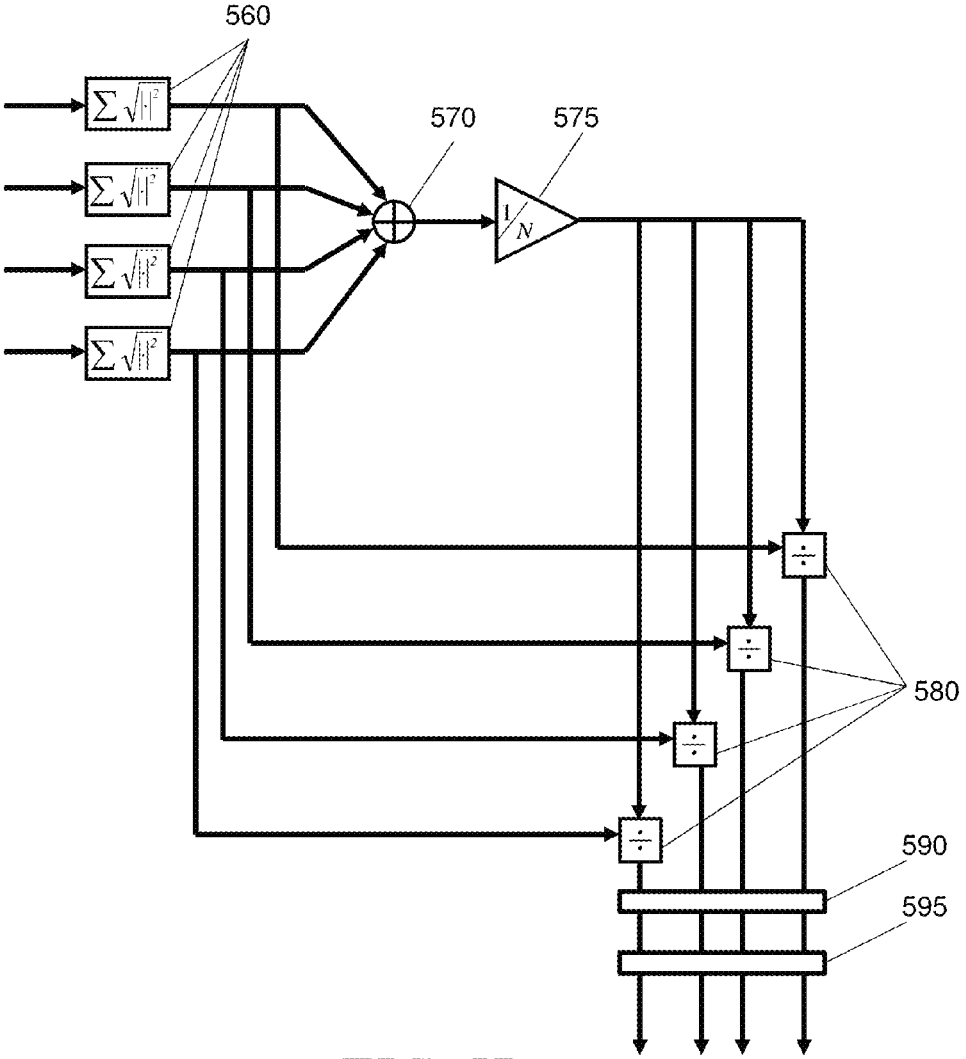
FIG. 5B depicts Bark-band equalization apparatus according to one embodiment.

Further details of the Bark-band equalizer 530 are depicted in FIG. 5B according to one embodiment of the invention. The Bark-band equalizer 530 may be configured to receive a plurality of spectral signals that originate from a plurality of microphones, and process the received spectral data according to a pre-programmed algorithm to compute equalization gain values at a plurality of frequencies for each of the plurality of microphones. In one embodiment, the Bark-band equalizer comprises at least one power spectral density (PSD) calculator 560, a combiner 570, a scaler 575, at least one divider 580, and a gain value mapper 595. In some embodiments, the Bark-band equalizer may further comprise a gain value monitor 590. The PSD calculator, combiner, scaler, divider, mapper and gain value monitor may be implemented in hardware only, e.g., digital and/or analog circuitry, or may be implemented in a combination of hardware and machine-readable instructions executed by at least one processor.

Each PSD calculator 560 may be configured to calculate power spectral density values at a plurality of frequencies of the spectral response received from the PSD calculator's respective microphone. In some embodiments, the plurality of frequencies at which power spectral density values are calculated are Bark-band frequency bins. In some embodiments, the plurality of frequencies at which power spectral density values are calculated correspond to FFT frequency bins that are determined by FFT units 520. Output values from each PSD calculator 560 may be provided to a combiner 570 and to a divider 580.

The combiner 570 may be configured to receive signals (e.g., calculated PSD values) from plural PSD calculators 560 and provide a combined output signal to scaler 575. The combiner 570 may combine the signals by adding the signals together. An output from the combiner 560 may be provided to and scaled by scaler 575.

Each divider 580 may be configured to receive a signal from the scaler 575 and PSD values from a respective PSD calculator 560, and provide first spectral equalization gain values at a plurality of frequencies that comprise a ratio of a received signal from the scaler 575 and received PSD values from the PSD calculator 560.

The first spectral equalization gain values may be provided directly to a multiplier 540 (not as shown in FIG. 5B), or may first be provided to a gain value monitor 590 that is configured to smooth calculated equalization gain values in time and/or frequency, so as to minimize abrupt changes in the calculated values that may be due to random noise errors. For example, the monitor 590 may be configured to compute a running time average of equalization gain values at each frequency. Alternatively, the gain value monitor 590 may be configured to limit changes in gain value, with respect to time or frequency, to a selected value (e.g., less than ±10% in some embodiments, less than ±20% in some embodiments, less than ±30% in some embodiments, or less than ±50% in some embodiments).

The first spectral equalization gain values may also be provided to mapper 595. Mapper 595 may be configured to map the first spectral equalization gain values at a first plurality of frequencies to second spectral equalization gain values at a second plurality frequencies. For example, the first gain values may be calculated for Bark-band frequency bines, and mapper 595 may map these gain values to second gain values for FFT frequency bins according to EQ. 8. The mapper 595 may be located before or after gain value monitor 590.

Each multiplier 540 *f* may be configured to multiply received equalization gain values by a spectral response received from a respective FFT unit 520 for the microphone to produce a compensated output signal. The spectral equalization gain values may be a single number in some embodiments, that alters the amplitude of the spectral data from the FFT unit at all frequencies similarly. In other embodiments, the spectral equalization gain values may be an array of values that are multiplied by respective frequency bins of the spectral data provided from an FFT unit 520.

Figure 5C:
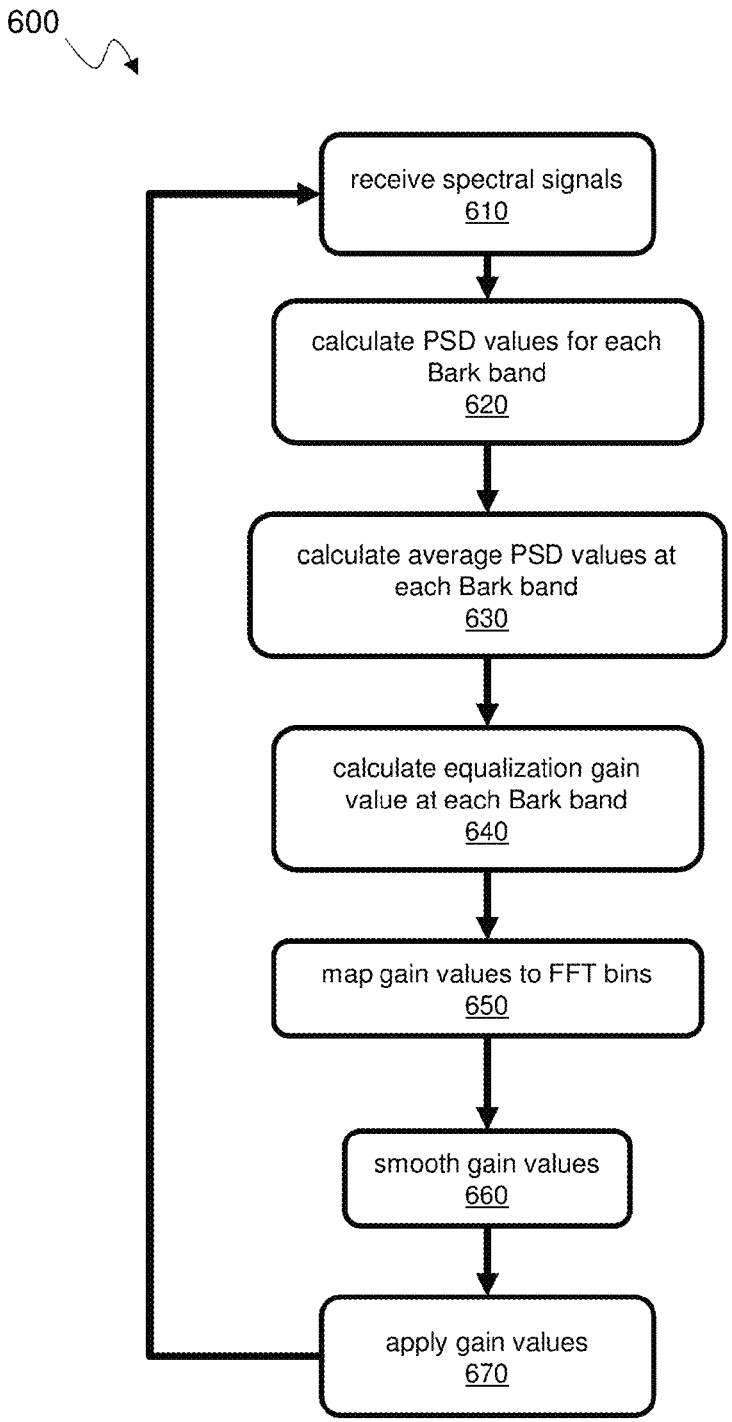
FIG. 5C is a flow chart illustrating a method for self-calibration of small microphone arrays according to one embodiment.

According to the foregoing description of compensating microphones in connection with Bark bands, a method for self-calibration of directional small-microphone arrays is depicted in FIG. 5C according to one embodiment. The method 600 may comprise acts of receiving 610 spectral signals from a plurality of microphones, and computing 620 power spectral density (PSD) values for each Bark band and for each microphone. The method 600 may further include calculating 630 an average PSD value at each Bark band based on the PSD values for each microphone at the respective Bark band. The average PSD value may be used to calculate 640 an equalization gain value for each microphone at each Bark band. The method 600 may further comprise mapping 650 equalization gain values to respective FFT bins for each microphone, and smoothing 660 the gain values in time and/or frequency to reduce abrupt changes in neighboring equalization gain values. The mapped and smoothed equalization gain values may be applied 670 to each of the microphones so as to match the responses of the microphones. The equalization gain values may be applied to multipliers 540, or in some embodiments to filters that process signals from the plurality of microphones.

It will be appreciated that some or all of the acts of the methods described above may be implemented as machine-readable instructions executed by at least one processor, e.g., by a microprocessor or microcontroller. In this regard, the inventive embodiments include manufactured storage media or manufactured storage devices encoded with machine-readable instructions that, when executed by at least one processor, cause the at least one processor to execute acts that carry out some or all of the functionality of the methods described above. Examples of manufactured storage media include RAM devices, ROM devices, magnetic or optical storage devices, magneto-optical storage devices, and charge storage devices.

Also, the technology described herein may be embodied as a method, of which at least one example has been provided. The acts performed as part of a method may be ordered in any suitable way. Accordingly, embodiments may be constructed in which acts are performed in an order different than illustrated, which may include performing some acts simultaneously, even though shown as sequential acts in illustrative embodiments. Some embodiments may also be constructed in which fewer acts than those illustrated are performed, or additional acts are performed.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art.

The claims should not be read as limited to the described order or elements unless stated to that effect. It should be understood that various changes in form and detail may be made by one of ordinary skill in the art without departing from the spirit and scope of the appended claims. All embodiments that come within the spirit and scope of the following claims and equivalents thereto are claimed.

What is claimed is:

1. An adaptive self-calibrating small microphone array comprising:

a plurality of microphones disposed in a two-dimensional or three-dimensional configuration;

a reference microphone; and a signal processor configured to associate a respective delay to responses from the plurality of microphones based on a spatial relationship of a respective microphone to the reference microphone, combine the responses from the plurality of microphones to form a combined response based on the respective delay, wherein the combined response is a mathematical approximation to a reference response, and compare the combined response to the reference response from the reference microphone.

2. The microphone array of claim 1, wherein the respective delay is based upon an approximation of a phase relationship for at least one of the plurality of microphones.

3. The microphone array of claim 1, wherein the signal processor comprises:

a combiner for combining the plural microphone responses;

a plurality of adaptive filters, each configured to receive an output from one of the plurality of microphones and provide a microphone response to the combiner; and a comparison unit configured to receive an output from the combiner for comparison with the reference response.

4. The microphone array of claim 3 disposed in a hearing aid.

5. The microphone array of claim 3 disposed in a hand-held portable electronic device.

6. The microphone array of claim 3 wherein a spacing between any two microphones in the array is less than about 2 millimeters.

7. The microphone array of claim 3, wherein an output from the comparison unit is fed back to at least one of the adaptive filters.

8. The microphone array of claim 3 comprising a delay element configured to delay a signal from one of the plurality of microphones.

9. The microphone array of claim 3, wherein the comparison unit is configured to determine a difference between the combined response and the reference response and provide a signal representative of the difference to the plurality of adaptive filters.

10. The microphone array of claim 3, wherein each adaptive filter is configured to compensate a respective received output responsive to feedback from the comparison unit to equalize the combined response and the reference response.

11. The microphone array of claim 1, wherein the reference response is obtained from the reference microphone that is one of the microphones in the directional microphone array.

12. The microphone array of claim 1, wherein the signal processor is configured to repeatedly execute the combining and comparing on an automated basis to compensate for variations in the microphone responses due to aging of the microphones or mechanical factors affecting acoustic responses of the microphones.

13. A method for compensating microphone responses for a directional microphone array system, the method comprising:

associating a respective delay to responses from a plurality of microphones of the directional array based on a spatial relationship of a respective microphone to a reference microphone;

combining a plurality of microphone responses from the plurality of microphones of the directional microphone array to form a combined response based on the respective delay, wherein the combining is such that the combined response mathematically approximates a reference response; and comparing the combined response to the reference response.

14. The method of claim 13, wherein the respective delay is based upon an approximation of a phase relationship for at least one of the plurality of microphones.

15. The method of claim 13, wherein the reference response is obtained from a reference microphone that is one of the microphones in the directional microphone array.

16. The method of claim 13, wherein the combining and comparing is carried out by a signal processor coupled to the plurality of microphones.

17. The method of claim 13, wherein the plurality of microphones are arranged in a two-dimensional or three-dimensional configuration.

18. The method of claim 13, further comprising obtaining the reference response from a data storage device or measuring the reference response from a reference microphone included with the directional microphone array.

19. The method of claim 13, further comprising repeatedly and automatically executing the combining and comparing to compensate for variations in the microphone responses due to aging of the microphones or mechanical factors affecting acoustic responses of the microphones.

20. The method of claim 13, wherein the comparing comprises calculating a difference between the combined response and the reference response to produce an error signal.

21. The method of claim 20, further comprising:

compensating a signal from at least one of the plural microphones responsive to the error signal to equalize the combined response and the reference response.

22. The method of claim 21, further comprising calculating an amount of compensation based upon the magnitude of the error signal.

23. The method of claim 21, wherein the compensating comprises adaptively filtering a response from the at least one of the plurality of microphones.

24. The method of claim 21, wherein the compensating comprises computing filter coefficients for an adaptive filter coupled to the at least one of the plurality of microphones and providing the computed filter coefficients to the adaptive filter.

* * * * *